US006257933B1

(12) United States Patent
Awaji

(10) Patent No.: US 6,257,933 B1
(45) Date of Patent: Jul. 10, 2001

(54) CONNECTOR

(75) Inventor: Toshiaki Awaji, Tokyo (JP)

(73) Assignee: Advantest Corporation, Tokyo (JP)

( * ) Notice: Subject to any disclaimer, the term of this patent is extended or adjusted under 35 U.S.C. 154(b) by 0 days.

(21) Appl. No.: 09/381,062

(22) PCT Filed: Jan. 11, 1999

(86) PCT No.: PCT/JP99/00053

§ 371 Date: Sep. 10, 1999

§ 102(e) Date: Sep. 10, 1999

(87) PCT Pub. No.: WO99/35719

PCT Pub. Date: Jul. 15, 1999

(30) Foreign Application Priority Data

Jan. 12, 1998 (JP) ..... 10-003826

(51) Int. Cl.[7] ..... H01R 24/00
(52) U.S. Cl. ..... 439/660; 439/78
(58) Field of Search ..... 439/660, 570, 439/569, 571, 572, 573, 574, 575, 555, 567, 62, 78, 82, 83, 84

(56) References Cited

U.S. PATENT DOCUMENTS

| | | | | |
|---|---|---|---|---|
| 4,738,625 | * | 4/1988 | Burton et al. | 439/59 |
| 4,907,987 | * | 3/1990 | Douty et al. | 439/571 |
| 5,310,357 | * | 5/1994 | Olson | 439/346 |
| 6,045,408 | * | 4/2000 | Takemasa | 439/660 |
| 6,146,203 | * | 11/2000 | Elco et al. | 439/609 |

FOREIGN PATENT DOCUMENTS

| | | |
|---|---|---|
| 789422 | 8/1997 | (EP) . |
| 62-79378 | 5/1987 | (JP) . |
| 9223531 | 8/1997 | (JP) . |

* cited by examiner

*Primary Examiner*—Gary F. Paumen
*Assistant Examiner*—Ross Gushi
(74) *Attorney, Agent, or Firm*—Gallagher & Lathrop; David N. Lathrop

(57) ABSTRACT

A connector is provided which is capable of being brought into good electrical contact with electrical connector portions formed on the surface of a printed board without deforming the printed board. In a connector comprising an elongated base member 21, an elongated extension 22 formed on one surface of the base member 21, and a plurality of tab contacts 211 arranged at predetermined intervals along the length of the base member, the tab contacts being adapted to make face contact with electrical connector portions formed on one surface of a printed board, a predetermined number of action pin accommodating compartments 212 are formed in one surface of the base member at predetermined intervals along the opposite longitudinal side edges of the base member, and action pins 211 are fixed in the corresponding action pin accommodating compartments 212. Each of the action pins comprises a head 211H adapted to be accommodated in the corresponding action pin accommodating compartment, an intermediate section 211M having an enlarged portion adapted to be embedded in the base member, and a drive portion 211P protruding outwardly from the base member, the drive portion including a bulged part 211A having resilience in the direction of thickness of the action pin.

5 Claims, 6 Drawing Sheets

60

CONNECTOR

TECHNICAL FIELD

The present invention relates to a connector having contacts adapted to contact with electrical connector portions formed on the surface of a printed board, and more particularly, to such connector suitable for use with a semiconductor device testing apparatus (commonly called IC tester) for testing various types of semiconductor devices including a semiconductor integrated circuit (IC).

BACKGROUND ART

Many semiconductor device testing apparatuses (which will hereinafter be referred to as IC tester) measure the electrical characteristics of semiconductor devices to be tested, i.e. devices under test (commonly called DUT), by applying a test signal of a predetermined pattern to the devices. Such IC testers have connected therewith a semiconductor device transporting and handling apparatus (commonly called handler) for transporting semiconductor devices to be tested to a test section where the semiconductor devices are brought into electrical contact with device sockets mounted to that portion which is called test head (a component of the IC tester for supplying and receiving various types of electrical signals for testing which will be referred to as test head hereinafter. After completion of the test, the handler carries the tested semiconductor devices out of the test section to a predetermined location and sorts them out into conforming or pass articles and non-conforming or failure articles on the basis of the test results. In the following disclosure, the present invention will be described for simplicity of explanation by taking by way of example semiconductor device integrated circuits (which will be referred to as IC hereinbelow), which are typical of semiconductor devices that are tested and measured.

First, the general construction of one example of the conventional handler called "horizontal transporting type" will be briefly described with reference to FIG. 7.

The illustrated handler 60 comprises a loader section 61 for transferring and reloading ICs to be tested (ICs under test) onto a test tray 64, a constant temperature chamber 65 containing a soak chamber 66 and a test section 67, an exit chamber 68 (also known as heat-removal/cold-removal chamber) for removing heat or cold from tested ICs carried on the test tray 64 from the test section 67 after completion of the test in the test section 67, and an unloader section 62 for receiving tested ICs carried on the test tray 64 from the exit chamber 68, and for transferring and reloading them from the test tray 64 onto a general-purpose or universal tray (also known as customer tray) 63.

The soak chamber 66 and the test section 67 of the constant temperature chamber 65 and the exit chamber 68 are arranged in the rear portion of the handler 60 in the order named from left to right in the right-to-left direction as viewed in the figure (this direction is referred to as X-axis direction herein) while the loader section 61 and unloader section 62 are located in front of the constant temperature chamber 65 and the exit chamber 68, respectively. Further, disposed in the forwardmost portion of the handler 60 is a tray storage section 70 for storing universal trays 63DT loaded with ICs to be tested, universal trays 63ST loaded with ICs already tested and sorted, empty universal trays 63ET, and the like.

The soak chamber 66 of the constant temperature chamber 65 is designed for imposing a temperature stress of either a predetermined high or low temperature on ICs to be tested loaded on a test tray 64 in the loader section 61 while the test section 67 of the constant temperature chamber 65 is designed for executing electrical tests on the ICs under the predetermined temperature stress imposed in the soak chamber 66. In order that the ICs loaded with the temperature stress of either a predetermined high or low temperature in the soak chamber 66 may be maintained in that temperature during the test, the soak chamber 66 and the test section 67 are both contained in the constant temperature chamber 65 capable of maintaining the interior atmosphere at a predetermined constant temperature.

The test tray 64 is moved in a circulating manner from and back to the loader section 61 sequentially through the soak chamber 66, the test section 67, the exit chamber 68, and the unloader section 62. In this path of circulating travel, there are disposed a predetermined number of test trays 64 which are successively moved by test tray transport means, not shown, in the direction as indicated by arrows in the figure.

A test tray 64, loaded with ICs to be tested from a universal tray 63 in the loader section 61, is conveyed from the loader section 61 to the constant temperature chamber 65, and then introduced into the soak chamber 66 through an inlet port formed on the front side of the constant temperature chamber 65. The soak chamber 66 is equipped with a vertical transport mechanism which is constructed to support a plurality of (say, five) test trays 64 in the form of a stack with a predetermined spacing between adjacent two test trays. In the illustrated example, a test tray newly received from the loader section 61 is supported on the uppermost tray support stage while the test tray which has been supported on the lowermost tray support stage is transported out to the test section 67 which on the right-hand side in the X-axis direction, adjoins and communicates with the lower portion of the soak chamber 66. It is thus to be appreciated that test trays 64 are delivered out in the direction perpendicular to that in which they have been introduced.

The vertical transport mechanism moves test trays supported on the successive tray support stages sequentially to the respective next lower tray support stages in the vertical direction (this direction is referred to as Z-axis direction). ICs to be tested are loaded with either a predetermined high or low temperature stress while the test tray supported on the uppermost tray support stage is moved sequentially to the lowermost tray support stage and during a waiting period until the test section 67 is emptied.

In the test section 67 there is located a test head, not shown. The test tray 64 which has been carried one by one out of the constant temperature chamber 65 is placed onto the test head where a predetermined number of ICs out of the ICs under test loaded on the test tray are brought into electrical contact with device sockets (not shown) mounted on the test head. Upon completion of the test on all of the ICs placed on one test tray through the test head, the test tray 64 is conveyed to the right in the X-axis direction to the exit chamber 68 where the tested ICs are relieved of heat or cold.

Like the soak chamber 66 as described above, the exit chamber 68 is also equipped with a vertical transport mechanism and is constructed to support a plurality of (say, five) test trays 64 stacked one on another with a predetermined spacing between adjacent two test trays. In the illustrated example, a test tray newly received from the test section 67 is supported on the lowermost tray support stage while the test tray supported on the uppermost tray support stage is discharged to the unloader section 62. The vertical transport mechanism moves test trays supported on the successive tray support stages sequentially to the respective next vertically upper tray support stages. The tested ICs are relieved of heat or cold to be restored to the outside temperature (room temperature) while the test tray supported on the lowermost tray support stage is moved sequentially to the uppermost tray support stage.

Since the test for ICs is typically conducted on ICs having a desired temperature stress in a wide range of temperatures from −55° C. to +125° C. imposed thereon in the soak chamber 66, the exit chamber 68 cools the ICs with forced air down to the room temperature if the ICs have had a high temperature of, say, about +120° C. applied thereto in the soak chamber 66. If ICs have had a low temperature of, say, about −30° C. applied thereto in the soak chamber 66, the exit chamber 68 heats them with heated air or a heater up to a temperature at which no condensation may occur. Although the test trays 64 loaded with ICs to be tested which are constructed of a material capable of withstanding such a wide range of temperatures, that is, capable of withstanding high/low temperatures, are usually employed, it is, of course, not required that the test trays 64 be constructed of a material capable of withstanding high/low temperatures if ICs are tested at the room temperature.

After the heat removal or cold removal process, the test tray 64 is conveyed in the direction perpendicular to that in which it has been introduced from the test section 67 (this direction is referred to as Y-axis direction) and toward the front of the exit chamber 68, and is discharged from the exit chamber 68 to the unloader section 62.

The unloader section 62 is configured to sort the tested ICs carried on the test tray 64 by categories based on the data of the test results and transfer them onto the corresponding universal trays 63. In this example, the unloader section 62 provides for stopping the test tray 64 at first and second two positions A and B. The ICs on the test trays 64 stopped at the first position A and the second position B are sorted out based on the data of the test results and transferred onto and stored in the universal trays of the corresponding categories at rest at the universal tray set positions (stop positions), four universal trays 64*a*, 64*b*, 64*c* and 64*d* in the example illustrated.

The test tray 64 emptied in the unloader section 62 is delivered to the loader section 61 where it is again loaded with ICs to be tested from the universal tray 63 to repeat the same steps of operation described above.

It should be noted here that the number of universal trays 63 that can be placed at the universal tray set positions in the unloader section 62 is limited to four in this example by the space available. Hence, the number of categories into which ICs can be sorted in real time operation is limited to four categories. While four categories would generally be sufficient to cover three categories for classifying "pass articles" into high, medium and low response rate elements respectively in addition to one category allotted to "failure article", in some instances there may be some among the tested ICs which do not belong to any of these four categories. Should there be found any tested IC which should be classified into a category other than the above four categories, a universal tray 63 assigned to the additional category should be taken from the tray storage section 70 and be transported to the universal tray set position in the unloader section 62 to store the IC in that universal tray. In doing that, it would also be needed to transport one of the universal trays positioned in the unloader section 62 to the tray storage section 70 for storage therein.

If the replacement of the universal trays is effected in the course of the sorting operation, the latter operation would have to be interrupted during the replacement. For this reason, in this example a buffer section 71 is disposed between the stop positions A and B for the test tray 64 and the locations of the universal trays 63*a*–63*d*. The buffer section 71 is configured to temporarily keep tested ICs belonging to a category of rare occurrence. The buffer section 71 may have a capacity of accommodating, say, about twenty to thirty ICs and be equipped with a memory portion for storing the categories of ICs placed in IC storage locations in the buffer section 71. Then, the location and category of each of the ICs temporarily kept in the buffer section 71 are stored in this memory portion. Between the sorting operations or upon the buffer section 71 being filled with ICs, a universal tray for the category to which the ICs kept in the buffer section belong is carried from the tray storage section 70 to the unloader section 62 to store the ICs in that universal tray. It should be noted that there may be a case that ICs temporarily kept in the buffer section 71 may be scattered over a plurality of categories. Accordingly, in the case that ICs temporarily kept in the buffer section 71 are scattered over a plurality of categories, it would be required to transport several kinds of universal trays at a time from the tray storage section 70 to the unloader section 62.

An X-Y transport (not shown) equipped with a movable head (which is known in the art concerned as pick-and-place) is usually used to transfer ICs to be tested from the universal tray 63 at a standstill at the universal tray set positions (stop positions) to a test tray 64. The IC pick-up pad (IC grasping member) mounted on the bottom surface of this movable head is brought into abutment with an IC placed on the universal tray 63 to attract and grasp it by vacuum suction for transfer from the universal tray 63 to the test tray 64. An X-Y transport of similar construction is used also to transfer tested ICs from the test trays 64 to the universal trays 63 in the unloader section 62. The movable head is usually provided with a plurality of, say, eight pick-up pads so that eight ICs at a time may be transferred between universal and test trays.

Although not shown, a tray transport is disposed above the tray storage section 70. In the loader section 61, the tray transport conveys a universal tray 63DT loaded with ICs to be tested from the tray storage section 70 to the universal tray set position (where ICs to be tested are to be transferred to a test tray). An emptied universal tray 63 is stored in a predetermined position (usually the location where empty universal trays 63ET are stored). Likewise in the unloader section 62, the aforesaid tray transport conveys universal trays of the various categories from the tray storage section 70 to the corresponding universal tray set positions (where the universal trays are to receive tested ICs from the test trays 64). Once one universal tray 63 has been fully filled, it is stored at a predetermined location in the tray storage section 70 while an empty universal tray 63ET is transported from the tray storage section 70 to the universal tray set position by the tray transport.

Further, in the loader section 61, an IC position corrector 69 called "preciser" is located between the universal tray set position and the stop position for the test tray 64. This preciser 69 includes relatively deep compartments into which ICs are allowed to fall down prior to being transferred from the universal tray to the test tray 64. The compartments are each bounded by slanted side walls which prescribe for the depth to which the ICs drop into the compartments. Once eight ICs have been positioned relative to each other by the preciser 69, those accurately positioned ICs are again grasped by the movable head and transferred to the test tray 64. The reason for providing such preciser 69 is this. The universal tray 63 is provided with compartments for holding ICs which are oversized as compared to the size of ICs, resulting in wide variations in positions of ICs stored in the universal tray 63. Consequently, if the ICs as such were grasped by the movable head and transferred directly to the test tray 64, there might be some of them which could not be successfully deposited into the IC storage compartments in the test tray 64. This is the reason for providing the preciser 69 which acts to array ICs as accurately as the array of the IC storage compartments in the test tray 64.

In the IC tester having connected therewith the handler of the construction as described above, a test head which is mounted to the test section 67 of the handler 60 is constructed separately from the IC tester proper (called main frame in the art concerned) in which there are accommodated main electric and electronic circuits, power sources, etc. The connection between the IC tester proper and the test head is established by means of electrical or optical signal transmission lines. The test head contains therein a measuring circuit (a circuit includes drivers, comparators and others; usually a pin card) and has a performance board mounted on the top thereof, which is formed by a multi-layer printed board. On this performance board there are mounted a predetermined number of device sockets (which are IC sockets as semiconductor devices to be tested are ICs in this example).

Typically, the test head is mounted on the bottom surface of the test section 67 of the handler 60 (usually the bottom surface of the constant temperature chamber) such that the IC sockets of the test head are exposed to the interior of the test section 67 of the handler 60 through an opening formed in the bottom surface of the test section 67. For this reason, the test head is mounted to the test section 67 of the handler 60 by means of a fixture (which is called Hi-fix base or test fixture in the art concerned).

As stated above, the performance board is constructed of a multi-layer printed board on the face of which a predetermined number of wiring patterns are formed radially, with one ends of the respective wiring patterns each comprising an electrical connector portion (pad). The opposite ends of the wiring patterns extend through the performance board in electrically insulated relation with each other so as to appear on the back surface (undersurface) thereof. Connected with the electrical connector portions on the front surface of the performance board are terminals of the IC sockets while the connectors which the present invention addresses are connected in face contact with the electrical connector portions (pads) exposed on the back surface of the performance board.

Next, the manner of electrical contact in which the connector is connected with the electrical connector portions on the back surface of the performance board will be described below with reference to FIGS. 5 and 6.

As shown in FIGS. 5 and 6, the connector 2 comprises an elongated base member 21 of generally rectangular shape in plan view, an extension 22 of generally rectangular shape in plan view extending longitudinally along the central portion of one side surface (undersurface as viewed in FIG. 5) of the base member 21 and projecting downwardly from the one side surface, and two rows of tab contacts 221 arranged on the opposite side surfaces of the extension 22 along the length of the base member 21 with a spacing between adjacent two tab contacts. The resilient contact portions at the free ends of these tab contacts 221 are adapted to make face contact with the corresponding electrical connector portions on the back surface of a performance board 1. It is thus to be understood that the electrical connector portions on the back surface of the performance board 1 are arranged in two rows so as to coincide with the spacings and positions of the tab contacts 221 of the connector 2.

In order to maintain the tab contacts 221 of the connector 2 in electrical contact with the electrical connector portions on the back surface of the performance board 1, it has heretofore been a practice to secure performance board 1 and the connector 2 together by fastening two positions of the longitudinal opposite ends of the connector with two bolts 11 inserted from the performance board side as shown in FIG. 5 with the tab contacts 221 of the connector 2 in face contact with the corresponding electrical connector portions on the back surface of the performance board 1.

In this case, as the bolts 11 are tightened, the back surface of the performance board 1 and the front surface of the connector 2 in those portions of the two surfaces where the tab contacts 221 of the connector 2 are in contact with the back surface of the performance board 1 (those portions extending between the two bolts 11) are prevented from being moved toward each other closer beyond a certain spacing due to the presence of the tab contacts 221 whereas the spacing between the back surface of the performance board 1 and the front surface of the connector 2 in those portions of the two surfaces where the tab contacts 221 of the connector 2 are not in contact with the back surface of the performance board 1 (those portions outward of the two bolts 11) is allowed to be further narrowed.

Since a great number of the tab contacts 221 are arrayed over a substantial length of the connector 2 and additionally since the performance board 1 does not have so high a mechanical bending strength, as the bolts 11 are progressively tightened, the performance board 1 is deformed with its central portion arched upwardly as shown in two-dotted chain lines in FIG. 5, so that the spacing between the back surface of the performance board 1 and the front surface of the connector 2 becomes greater with an increase in the distance from where they are fastened together by the bolts 11.

As a result, there was a serious drawback that the integrity of the face contact between the tab contacts 221 of the connector 2 and the electrical connector portions on the back surface of the performance board 1 failed in their central portions. Nevertheless, if the tightening force of the bolts 11 was lightened in order to avert this drawback, the face contact between the tab contacts 221 of the connector 2 and the electrical connector portions on the back surface of the performance board 1 became generally inadequate, resulting undesirably in an increase in contact resistance and hence lowering in reliability.

The aforesaid drawback is also the case with the instance where the tab contacts of the connector constructed as discussed above are to be electrically connected with electrical connector portions formed on the surfaces of a printed board other than the performance board. For example, when the tab contacts of the connector constructed as described above are electrically connected with a printed board used on a Hi-fix base, the printed board and the connector are likewise fastened together with two bolts 11, resulting in occurrence of the similar drawback.

DISCLOSURE OF THE INVENTION

An object of the present invention is to provide a connector which is capable of being brought into good electrical contact with electrical connector portions formed on the surface of a printed board without deforming the printed board.

Another object of the present invention is to provide a connector which is capable of being brought into good electrical contact with electrical connector portions formed on a performance board which is mounted on a test head of a semiconductor device testing apparatus.

Still another object of the present invention is to provide a connector which is capable of being brought into good electrical contact with electrical connector portions formed on a printed board used in a Hi-fix base for joining a test head of a semiconductor device testing apparatus and a test section.

In order to accomplish the foregoing objects, in a first aspect of the present invention, there is provided a connector comprising an elongated base member, an elongated extension formed on one surface of the base member, and a plurality of tab contacts arranged at predetermined intervals along the length of the base member, the tab contacts being adapted to make face contact with electrical connector portions formed on one surface of a printed board, and further comprising a plurality of action pins arranged in the base member at predetermined intervals along the length of the base member.

The aforesaid tab contacts are arranged on the opposite side surfaces of the elongated extension while the action pins are arranged in one surface of the base member at predetermined intervals along the opposite longitudinal side edges of the base member.

In a preferred embodiment, the aforesaid tab contacts are arranged in a plurality of sets arranged at predetermined intervals, each set comprising three tab contacts, such that the tab contacts on one side surface of the extension and those on the other side surface of the extension are arranged in a format staggered longitudinally of the extension while the action pins are arranged in the base member at positions corresponding to those positions where there are no tab contacts on the adjacent side surface of the extension.

The aforesaid action pins are located in respective action pin accommodating compartments formed in the one surface of the base member at predetermined intervals along the opposite longitudinal side edges of the base member.

Each of the aforesaid action pins comprises a head adapted to be accommodated in the corresponding action pin accommodating compartment, an intermediate section having an enlarged portion adapted to be embedded in the base member, and a drive portion protruding outwardly from the other surface of the base member and terminating in a pointed tip, the drive portion of the action pin having a bulged part in outward proximity of the other surface of the base member, the bulged part having resilience in the direction of thickness of the action pin.

A pair of metal plate-like retainers are embedded in the base member along the opposite longitudinal side edges of the base member with one surfaces of the plate-like retainers being exposed at the bottom surfaces of the action pin accommodating compartments.

BEST MODES FOR CARRYING OUT THE INVENTION

Figure 5:
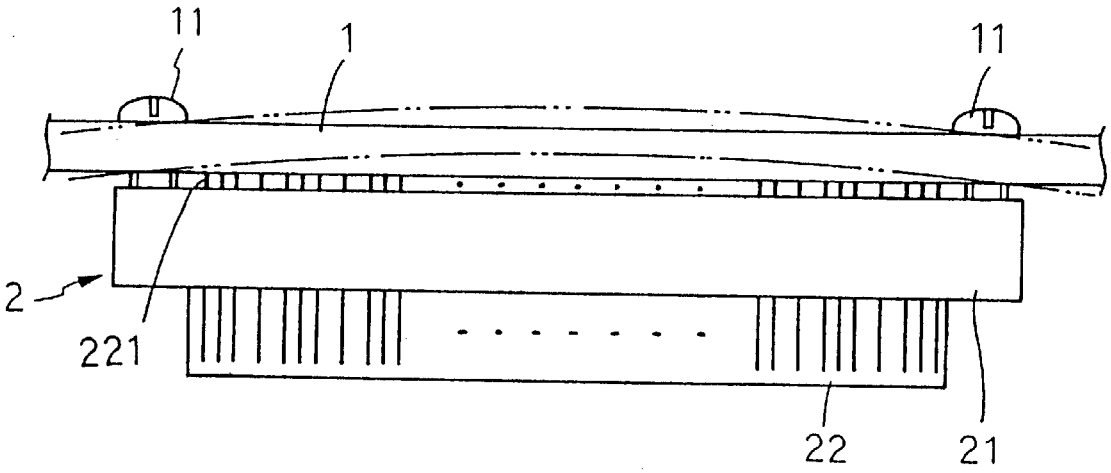
FIG. 5 is a side view schematically illustrating the test head utilizing the conventional connector.
Figure 6:
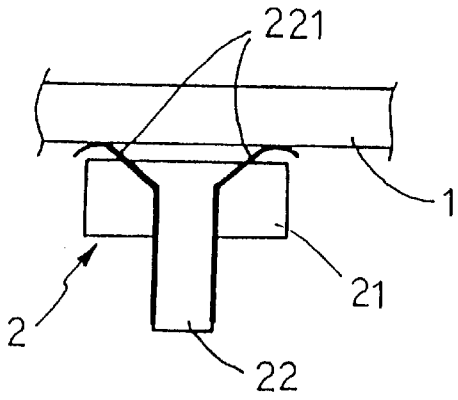
FIG. 6 is a side view seen from the right-hand side of FIG. 5 illustrating the manner of electrical contact between the electrical connector portions on the performance board shown in FIG. 5 and the tab contacts of the connector.
Figure 7:
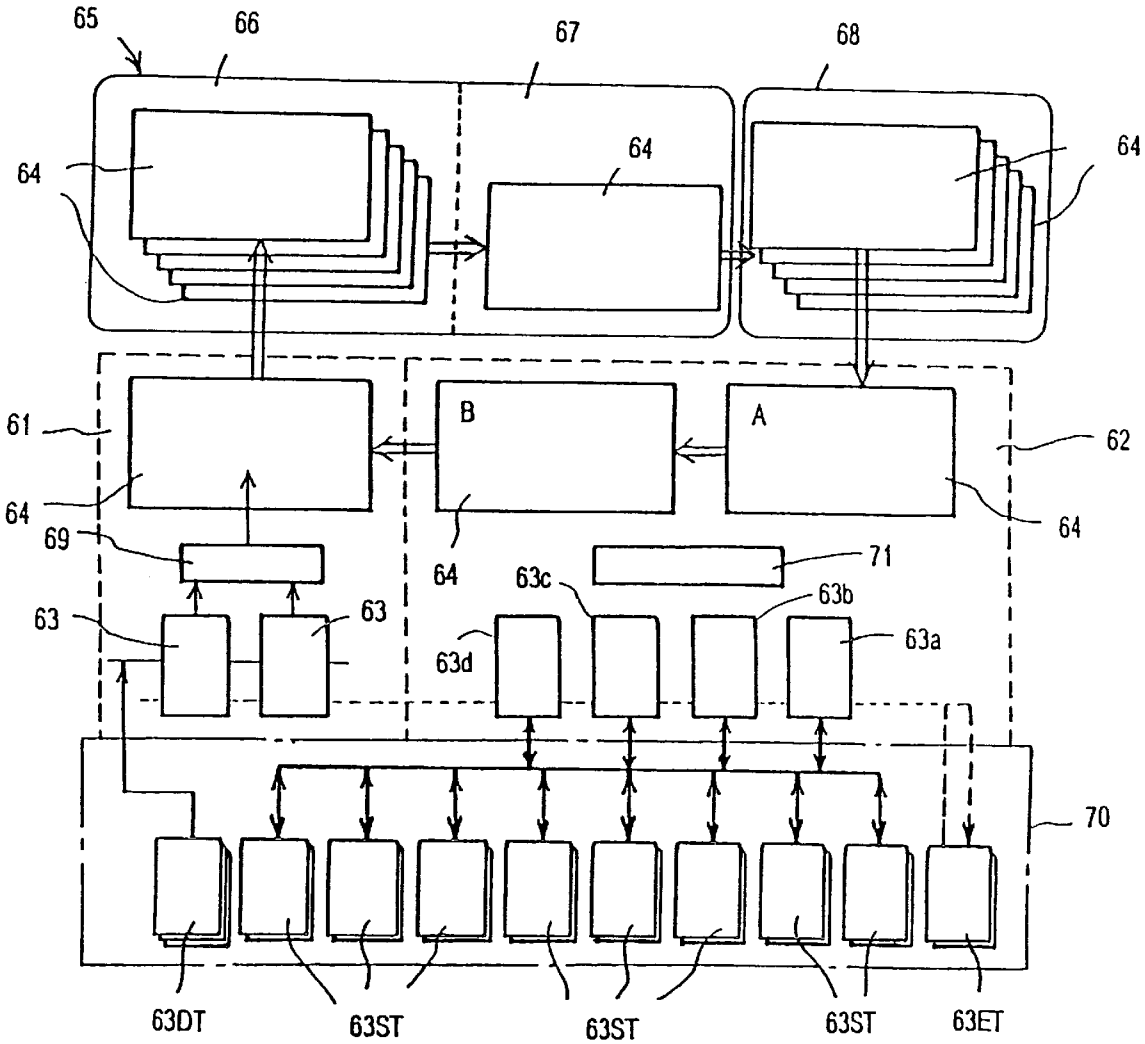
FIG. 7 is a representation illustrating the general construction of one example of the semiconductor device testing apparatus to which the present invention is applicable.

Now, an embodiment of the connector according to the present invention will be described in detail with reference to FIGS. 1 through 4. It is to be noted that in FIGS. 1 through 4, the portions and members corresponding to those of FIGS. 5 and 6 are designated by the same reference numerals for the benefit of understanding and will not be discussed again in detail, unless required.

Figure 1:
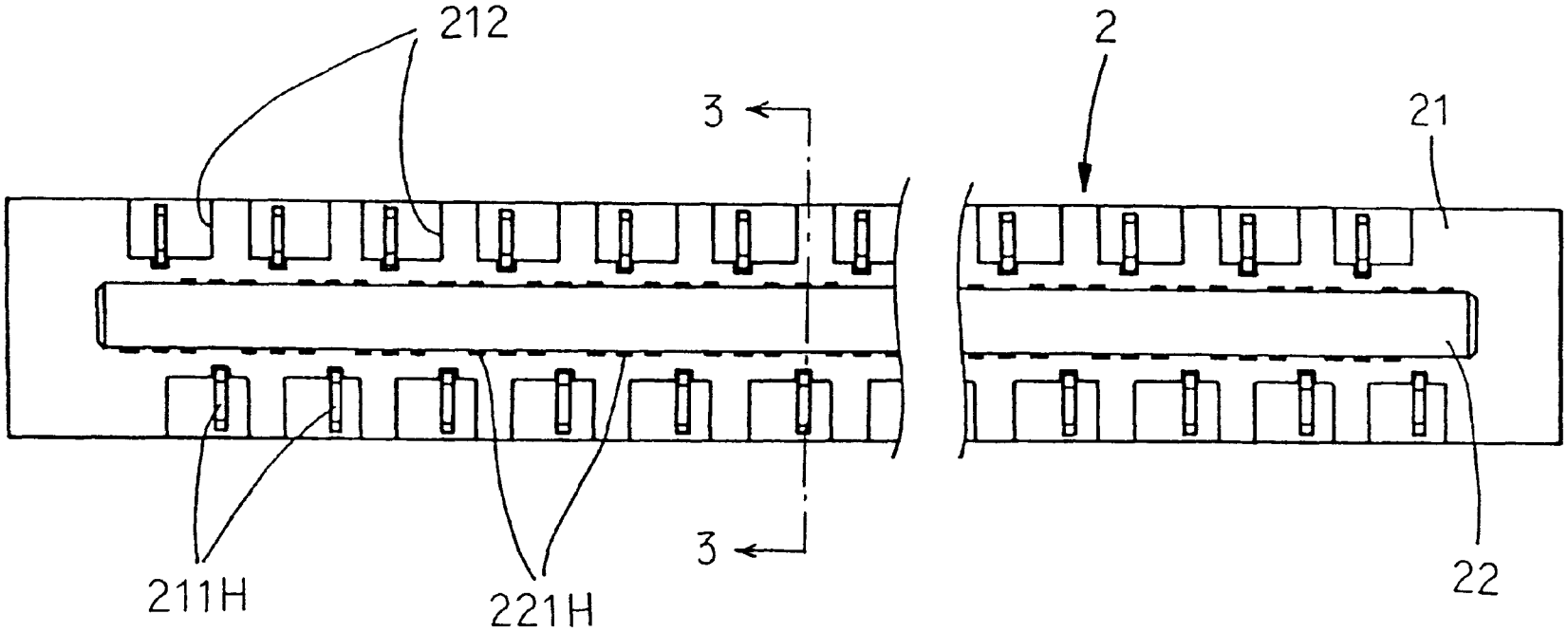
FIG. 1 is a plan view illustrating one embodiment of the connector according to the present invention.
Figure 2:
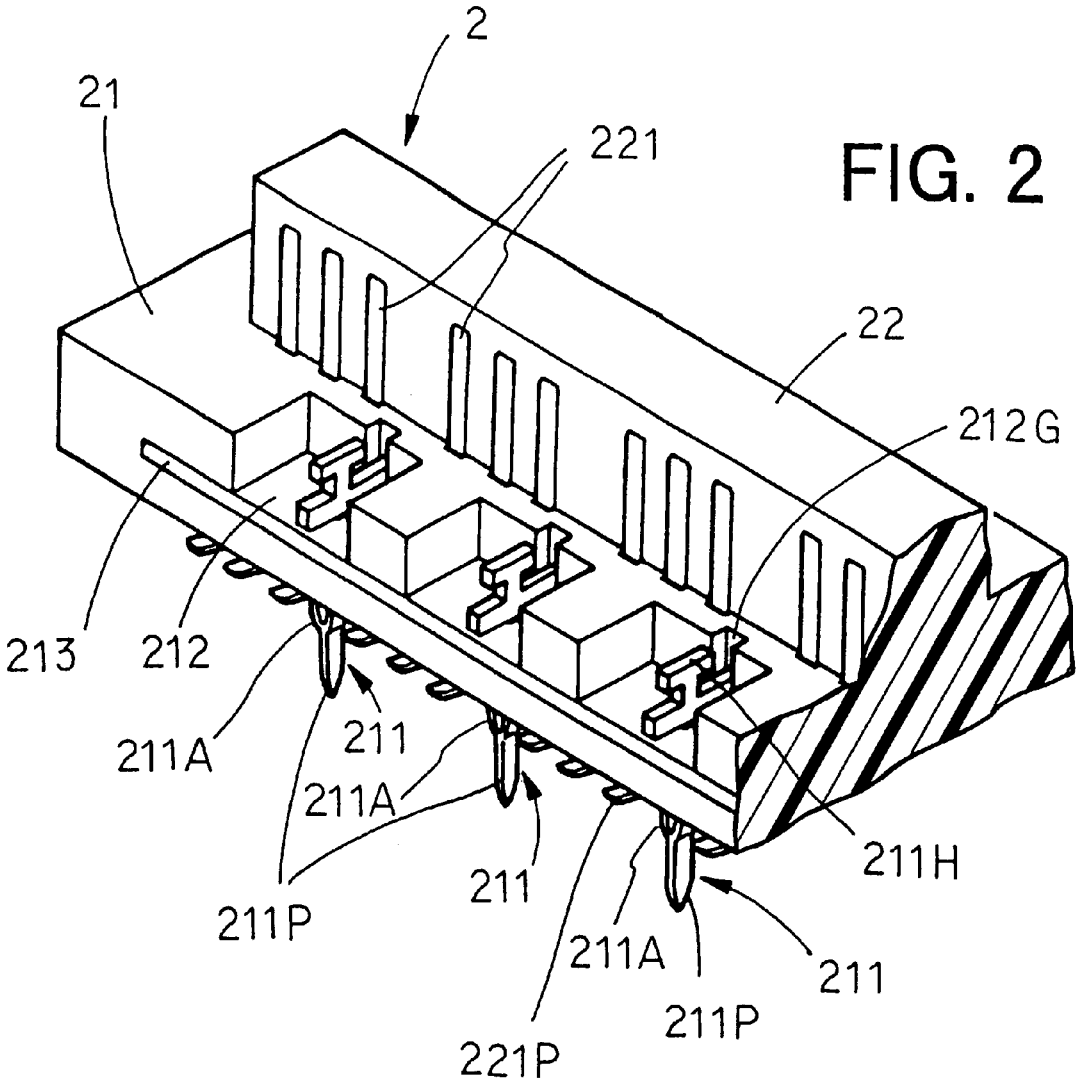
FIG. 2 is a perspective view of a portion of the connector shown in FIG. 1.
Figure 3:
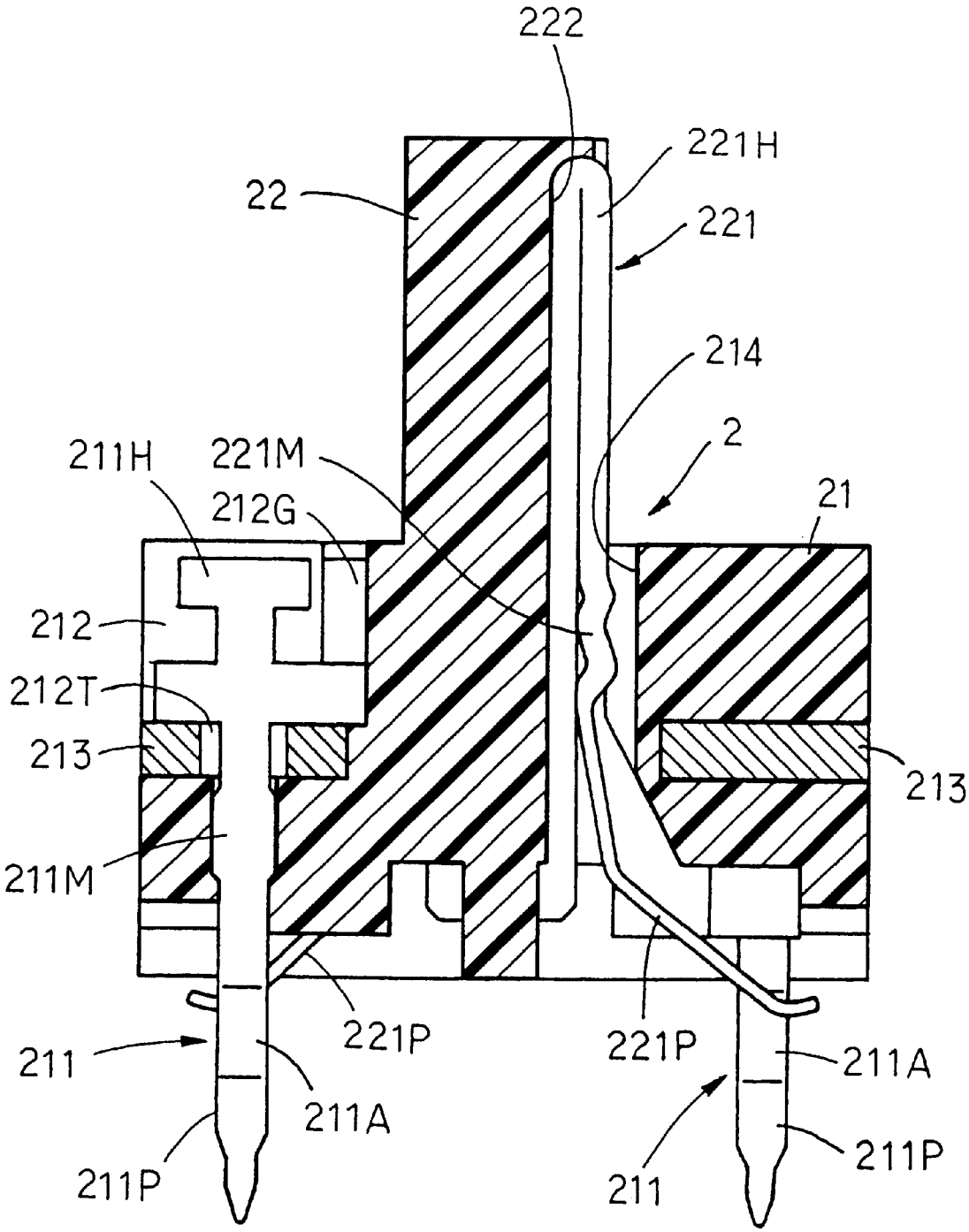
FIG. 3 is a cross-sectional view taken along the line 3—3 of FIG. 1 and seen in the direction indicated by the arrows in FIG. 1.

As will be readily appreciated from FIGS. 1–3, the connector 2 according to this embodiment of the invention comprises an elongated base member 21 of generally rectangular shape in plan view, an extension 22 of generally rectangular shape in plan view extending longitudinally along the central portion of one surface (upper surface as viewed in these drawings) of the base member 21 and projecting upwardly from the one surface, and two rows of tab contacts 221 arranged on the opposite side surfaces of the extension 22 at predetermined intervals along the length of the base member 21.

The tab contacts 221 are arranged in sets each comprising three closely spaced ones in this embodiment as shown in FIGS. 1 and 2, and the tab contacts on one side surface of the extension 22 and those on the other side surface of the extension are arranged in a format staggered longitudinally of the extension. More specifically, the third tab contact of any one set of three tab contacts on the one side surface of the extension 22 is positioned in opposition to the first tab contact of one set of three tab contacts on the other side surface such that the middle (the second) tab contact of any one set of three tab contacts on the one side surface of the extension 22 is arranged alternately with the middle (the second) tab contact of one set of three tab contacts on the other side surface. The middle tab contact of each set of tab contacts is used as a signal line while the both side tab contacts are used as ground or earth lines, so that it is to be appreciated that the arrangement in which the middle tab contact of each set of tab contacts used as a signal line is arranged alternately on the one side surface and on the other side surface is designed to prevent the occurrence of mutual interference between high-frequency signals.

Each tab contact 221 is formed of an elongated strip of metal sheet having resiliency such as phosphor bronze by bending the strip. More specifically, as illustrated in FIG. 3, an elongated strip of resilient metal sheet is folded through 180° at the midpoint thereof to divide it into a base side elongated strip segment and a contact side elongated strip segment, the middle portion 221M of which is corrugated to provide increased rigidity while that portion of the contact side elongated strip segment extending forwardly of the middle portion 221M is reduced in thickness to provide increased resiliency and is bent at two spaced points outwardly away from the base side elongated strip segment, terminating in curved forward end (free end). That portion of the contact side elongated strip segment toward the folded portion defines a connector contact part 221H of the tab contact 221 while the thickness-thinned outwardly bent forward end portion (including the curved portion) of the contact side elongated strip segment defines a contact blade 221P of the tab contact 221.

As will be appreciated from FIG. 3, the opposite longitudinal side surfaces of the extension 22 have formed therein tab contact fitting grooves 222 extending vertically thereof and through the base member 21 at predetermined intervals along the respective side surfaces, the grooves 222 being adapted to fit the corresponding base side elongated strip segments of the tab contacts 221 widthwise thereof. The base member 21 has through-bores 214 formed therethrough which continue from the corresponding tab contact fitting grooves 222 extending vertically thereof, the through-bores 214 being adapted to fit the middle portion 221M of the tab contacts 221 widthwise thereof. As described above, as the tab contacts 221 are arranged in a number of sets each comprising three tab contacts, the tab contact fitting grooves 222 and the through-bores 214 are likewise formed at the corresponding positions. In addition, the base member 21 has compartments formed in the bottom surface thereof at the locations where the tab contacts 221 are positioned which compartments are deeper than those portion of the bottom surface of the base member 21 where action pins 211 are positioned.

Each tab contact 221 is inserted a corresponding through-bore 214 and fitting groove 222 from the bottom surface side of the base member 21 until the base side elongated strip segment of the tab contact is fitted and fixed in the through-bore 214 and fitting grooves 222 (a portion of the contact side elongated strip segment of the tab contact 221 is also fitted and fixed in the through-bore 214 and fitting grooves 222). The connector contact part 221H of the contact side elongated strip segment of each tab contact 221 becomes exposed on its outer surface so as to define a connector contact part for electrically contact with a contact of a receptacle (female) connector, not shown. On the other hand, the contact blade 221P of each tabs contact 211 is firstly bent outwardly in the through-bore 214 of the base member 21 and then further bent outwardly immediately after emerging from the through-bore 214 to extend obliquely, terminating in a curved free end. The curved portion of the contact blade 221P is located below the bottom surface of the base member 21 to be electrically contacted by an electrical connector portion (electrically conductive pad) formed on the surface of a printed board, not shown.

According to the present invention, in the connector 2 constructed as described above, a predetermined number of action pin accommodating compartments 212 are formed in one surface of the base member 21 at predetermined intervals along the opposite longitudinal side edges of the base member, and action pins 211 are accommodated in the respective action pin accommodating compartments 212. In the illustrated embodiment, each action pin 211 is disposed at a location where there are no action pins 211 on the adjacent side surface of the extension 22.

Each action pin 211 is secured to the base member 21 by being driven or hammered into a through-bore formed in the bottom surface of the action pin accommodating compartment 212 and extending vertically through the base member 21. More specifically, the action pin 211 is secured to the base member 21 by being driven into the through-bore until its head 211H comes into abutment against the bottom surface of the action pin accommodating compartment 212. In addition to the head 211H, each action pin 211 comprises an intermediate section 211M having an enlarged portion adapted to be embedded in the base member 21, and a drive portion 211P protruding outwardly from the bottom surface of the base member 21 and terminating in a pointed tip, the drive portion 211P having a bulged part (action part) 211A in outward proximity of the undersurface of the base member 21.

The aforesaid through-bore formed in the bottom surface of the action pin accommodating compartment 212 is sized in the illustrated embodiment so as to be approximately equal to the width dimension and the thickness dimension (the dimensions excluding the bulged part 211A) of the drive portion 211P.

The aforesaid bulged part 211A, as will be appreciated from FIG. 2, is formed by separating the thickness of the body of the action pin 211 into two thin plates and curving and bulging the two thin plates outwardly away from each other. Consequently, the two thin plates define a hollow space therebetween and have resilience in the direction of thickness.

The head 211H of the action pin 211 in the illustrated embodiment has two cross members (horizontal members) the upper one of which is shorter than the lower one (in the form of the letter "I" as viewed from the front), with one end of the lower cross member being fitted in a fitting groove 212G formed in a longitudinal side wall (central wall) of action pin accommodating compartment 212. The fitting groove 212G serves to guide the action pin 211 while constraining it in position when the action pin 211 is driven or hammered and fixed into the through-bore in the base member 21.

A pair of retaining bars 213 made of stainless steel, for example, are embedded horizontally in the base member 21 along the opposite longitudinal side edges of the base member 21 with one longitudinal side surface of the retaining bars being exposed to the opposite side surfaces of the base member 21. The top surface of each of the retaining bars 213 is exposed on the bottom surfaces of the action pin accommodating compartments 212. The retaining bar 213 serves to retain the action pin 211 while at the same time mechanically protecting the base member 21 when the action pin 211 is driven or hammered into the base member 21 or a performance board or another printed board. Each retaining bar 213 has through-apertures 212T (see FIG. 3) in alignment with the through-bores in the bottom surfaces of the action pin accommodating compartments 212, each of the through-apertures being adapted for allowing the intermediate section 211M and the drive portion 211P of the corresponding action pin 211 to pass therethrough in a loose fit manner but the head 211H not to pass therethrough.

It can thus be understood that when placing the contact blades 221P of the tab contacts 221 into contact with the electrical connector portions formed on the surface of a printed board, the connector 2 having a predetermined number of action pins 211 arranged in the base member 21 along the opposite longitudinal side edges of the base member 21 may easily be secured to the printed board by driving the drive portions 211P of the action pins 211 into the printed board.

Due to a multiplicity of action pins 211 arranged along the opposite longitudinal side edges of the base member 21, the connector 2 and the printed board may be mechanically secured together with uniformly distributed forces. As a result, the face contact between the tab contacts 221 of the connector 2 and the electrical connector portions on the surface of the printed board is satisfactory over the entire length of connector 2, in contrast to the prior art attended with the drawback that the face contact becomes inadequate in the central portion.

Figure 4:
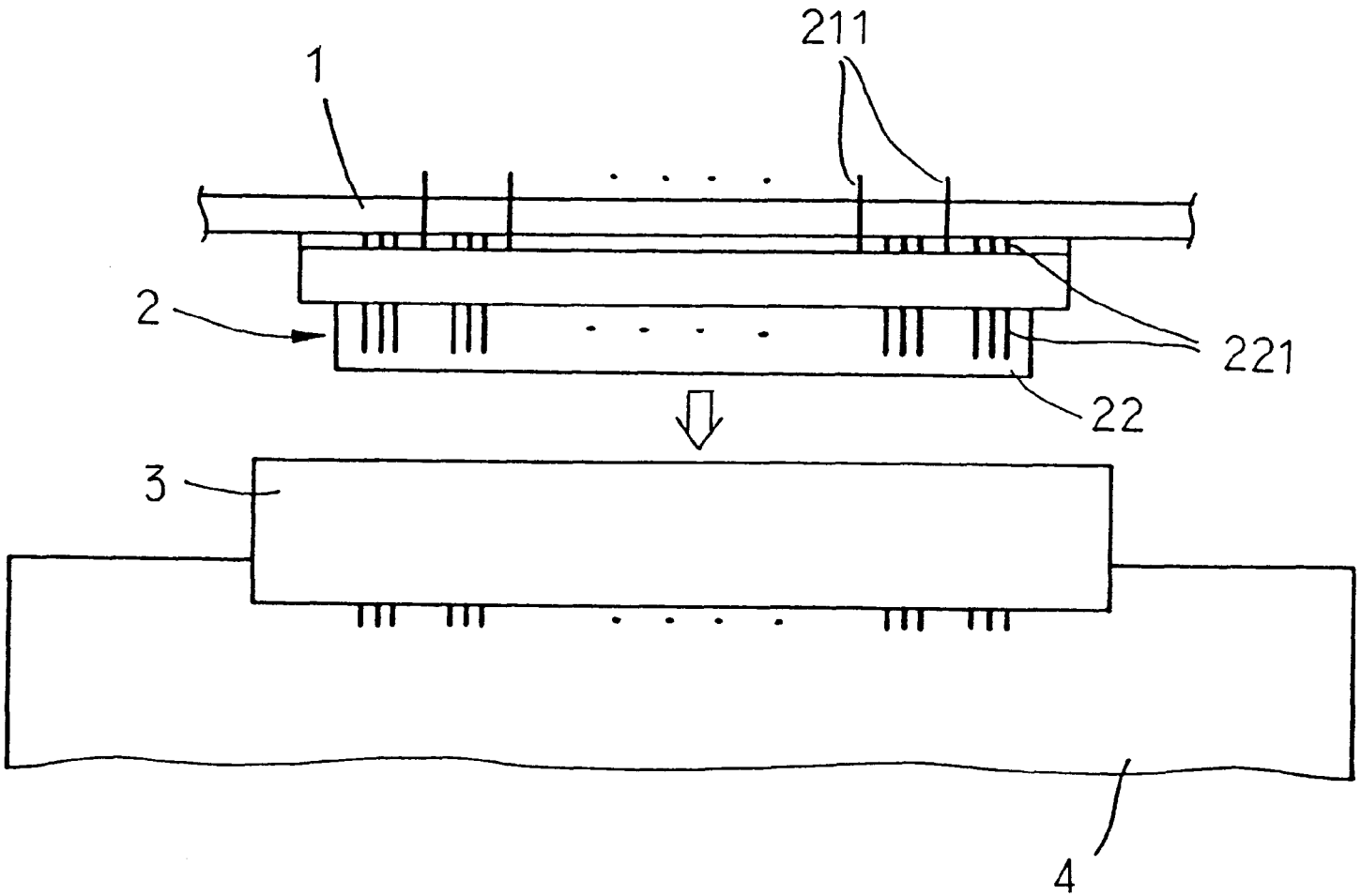
FIG. 4 is a side view schematically illustrating the test head utilizing the connector according to the present invention.

FIG. 4 illustrates one instance in which the connector 2 constructed as described above is utilized as a connector for the performance board 1 of the test head of the IC tester. It is seen from the drawing that the connector 2 may easily be fixed to the performance board 1 by driving the drive portions 211P of the action pins 211 into the performance board 1. More specifically, the connector 2 and the performance board 1 are brought into alignment, and the head 211H of the action pin 211 fixed to the base member 21 is pressed on to drive the drive portion 211P of the pin into the performance board 1. The bulged part 211A of the drive portion 211P of the action pin 211 has resilience in the direction of thickness, so that the mechanical joint between the performance board 1 and the connector 2 is ensured by the resilience of the bulged part 211A of the drive portion 211P of the action pin 211 driven into the performance board 1. In addition, since the performance board 1 and the connector 2 are mechanically secured together in their entire opposed surfaces with uniformly distributed forces by a multiplicity of action pins 211, there occurs no deformation of the performance board 1.

As can be appreciated from the foregoing, the face contact between the contact blades 221P of the tab contacts 221 of the connector 2 and the electrical connector portions on the surface of the performance board 1 is maintained in satisfactory state over the entire length of connector 2, causing no contact failure and hence enhancing reliability. The resilience in the direction of thickness of the bulged part 211A of the drive portion 211P of the action pin 211 facilitates the operation of driving the action pin 211 into the performance board 1, and yet ensure a firm mechanical joint between the two. On the other hand, when it is desired to remove the connector 2 from the performance board 1, the head 211H of the action pin 211 is grasped and pulling force is applied to the action pin whereupon the bulged part 211A is easily collapsed to permit easy withdrawal of the action pins 211 from the performance board 1. Hence, the replacement operation of the connector 2 is also facilitated.

It should be noted here that the connector 2 is electrically connected with a receptacle connector 3 which is connected with a pin card (pin electronics card) in the test head by the extension 22 of the connector 2 being fitted in the receptacle connector 3 as indicated in the arrow in FIG. 4.

It can be understood from the foregoing that the action pins 211 used with the connector 2 according to the present invention are ones used for mechanically securing the connector 2 and a printed board, for example, a performance board together with uniformly distributed forces and maintaining a mechanical joint between the two, but are not ones used for electrical connection between the two. It should also be noted that instead of preliminarily attaching the action pins 211 to the base member 21 of the connector 2 by driving the pins into the base member, the action pins 211 may be driven from the base member 21 into a performance board 1 or an other printed board when mechanically attaching the connector 2 to the performance board 1 or the other printed board.

While FIG. 4 illustrates the instance where the connector 2 according to the present invention is electrically connected with the performance board attached to the test head of the IC tester, it is needless to say that the connector 2 according to the present invention may be used for connection with the electrical connector portions formed on the surface of a printed board other than a performance board such as the electrical connector portions formed on the surface of a printed board used with a Hi-fix base. Of course, the connector 2 may also be used for connection with the electrical connector portions formed on the surface of a printed board used with equipment other than IC testers.

As discussed above, in the present invention, a predetermined number of action pins are arranged in the base member of the connector along the opposite longitudinal side edges of the base member, so that the connector and the printed board may be mechanically joined together while at the same time the contact blades at the forward ends of the tab contacts of the connector are put into contact with the electrical connector portions on the surface of the printed board by driving the action pins into the printed board, whereby the connector and the printed board may be mechanically joined together by the action pins with uniformly distributed forces over the entire surfaces. As a result, the invention produces the remarkable advantage that the face contacts between the tab contacts of the connector and the electrical connector portions on the surface of the printed board is satisfactory over the entire length of connector 2, leading to enhanced reliability. In addition, the present invention only requires driving the action pins into the printed board, facilitating the operation of mechanically joining them together as well as the operation of removal, so that there occurs no problem in the aspect of workability.

What is claimed is:

1. A connector comprising:

an elongated base member, an elongated extension formed on one surface of said base member, a plurality of tab contacts arranged at predetermined intervals on opposite longitudinal side surfaces of said elongated extension, said tab contacts being adapted to make face contact with electrical connector portions formed on one surface of a printed board, wherein said tab contacts are arranged in a plurality of sets arranged at predetermined intervals, each set comprising three tab contacts, such that said tab contact sets on one side surface of said extension and those on the other side surface of said extension are arranged in a format staggered longitudinally of said extension; and a plurality of action pins arranged in said one surface of said base member at predetermined intervals along the opposite longitudinal side edges of said base member, wherein said action pins are arranged in said base member at positions corresponding to those positions where there are no tab contacts on the adjacent side surface of said extension.

2. The connector as set forth in claim 1, wherein a pair of metal plate-like retainers are embedded in said base member along the opposite longitudinal side edges of said base member.

3. A connector comprising:

an elongated base member, wherein a pair of metal plate-like retainers are embedded in said base member along the opposite longitudinal side edges of said base member with one surfaces of said plate-like retainers being exposed at the bottom surfaces of said action pin accommodating compartments, an elongated extension formed on one surface of said base member, a plurality of tab contacts arranged at predetermined intervals on opposite longitudinal side surfaces of said elongated extension, said tab contacts being adapted to make face contact with electrical connector portions formed on one surface of a printed board, and a plurality of action pins arranged in said one surface of said base member at predetermined intervals along the opposite longitudinal side edges of said base member, wherein said action pins are located in corresponding action pin accommodating compartments formed in said one surface of said elongated base member at predetermined intervals along the opposite longitudinal side edges of said base member.

4. The connector as set forth in claim 3, wherein each of said action pins comprises a head adapted to be accommodated in the corresponding action pin accommodating compartment, an intermediate section having an enlarged portion adapted to be embedded in said base member, and a drive portion protruding outwardly from the other surface of said base member and terminating in a pointed tip, said drive portion of said action pin having a bulged part in outward proximity of the other surface of said base member, said bulged part having resilience in the direction of thickness of said action pin.

5. The connector as set forth in claim 3 or 4, wherein each of said plate-like retainers has through-apertures formed in those portions thereof exposed at the bottom surfaces of said action pin accommodating compartments, each of said through-apertures being adapted to allow the corresponding action pin to pass therethrough in a loose fit manner.

* * * * *